US007334176B2

(12) United States Patent
Schröder

(10) Patent No.: US 7,334,176 B2
(45) Date of Patent: Feb. 19, 2008

(54) DETERMINATION OF THE PRESENCE OF ADDITIONAL CODED DATA IN A DATA FRAME

(75) Inventor: Ernst F. Schröder, Hannover (DE)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 10/495,838

(22) PCT Filed: Nov. 2, 2002

(86) PCT No.: PCT/EP02/12251

§ 371 (c)(1),
(2), (4) Date: Nov. 2, 2004

(87) PCT Pub. No.: WO03/042980

PCT Pub. Date: May 22, 2003

(65) Prior Publication Data

US 2005/0081134 A1 Apr. 14, 2005

(30) Foreign Application Priority Data

Nov. 17, 2001 (EP) ..... 01250406

(51) Int. Cl.
*H04L 1/14* (2006.01)

(52) U.S. Cl. ..... 714/750; 714/776; 714/775

(58) Field of Classification Search ..... 714/776, 714/775

See application file for complete search history.

(56) References Cited

U.S. PATENT DOCUMENTS 4,910,736 A * 3/1990 Tanaka et al. ..... 714/758

(Continued)

FOREIGN PATENT DOCUMENTS

EP 640909 3/1995

(Continued)

OTHER PUBLICATIONS

E. F. Schroeder et al: "Der MPEG-2-Standard: Generische Codierung Fuer Bewigtbilder und Zugehoerige Audio-Information. Audio-Codierung (Teil 4)", Fernseh und Kinotechnik, vol. 48, No. 7/8, Aug. 30, 1994, pp. 364-368, 370-373.

(Continued)

*Primary Examiner*—Guy Lamarre
*Assistant Examiner*—Sam Rizk
(74) *Attorney, Agent, or Firm*—Joseph J. Laks; Robert B. Levy; Jorge Tony Villabon

(57) ABSTRACT

An mp3-standard bitstream is formatted into a sequence of fixed-length data frames. These include headers, side information, main information and a remaining data field without generally defined information denoted as 'ancillary data'. The mp3PRO format is an extension of the mp3 format, wherein the additional mp3PRO data are transferred in the ancillary data fields. In various applications, e.g. Internet music search machines, a necessity arises for a fast determination of the bitstream types. Such determination is normally executed using an mp3PRO decoder. However, because the frame header does not contain a corresponding pointer to the start address of the ancillary data field, an mp3PRO decoder must first completely decode at least one data frame according to the mp3 standard in order to find the end address of the mp3 data and thereby the following start address of the mp3PRO data in that data frame. Thereafter the mp3PRO decoder must examine the data following in the data stream for characteristics that are typical for mp3PRO additional information. The invention discloses how the bitstream type can be determined without using mp3 decoding and without using an mp3PRO decoder.

11 Claims, 3 Drawing Sheets

U.S. PATENT DOCUMENTS

Figure 1:
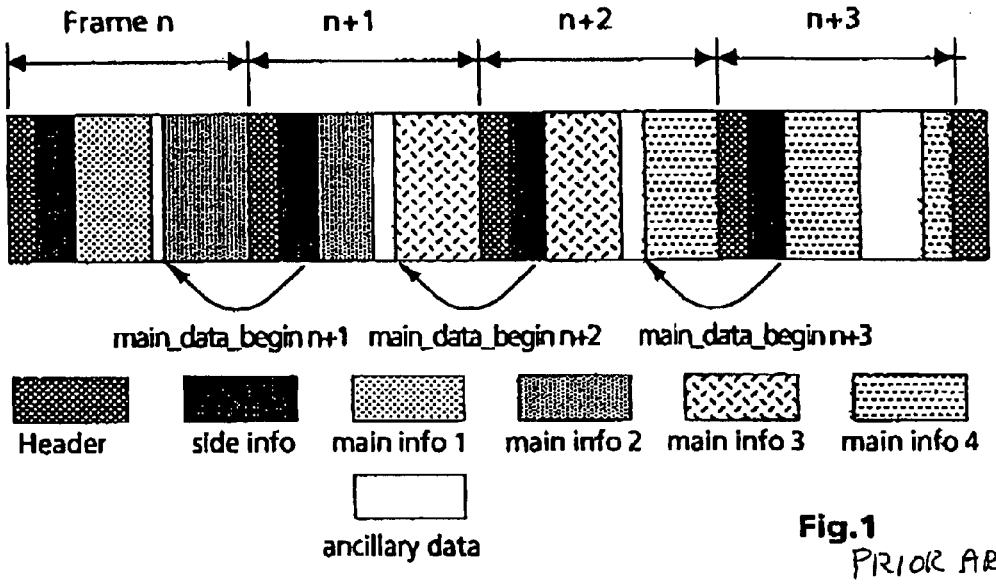
Fig.1 PRIOR ART

| | | | | |
|---|---|---|---|---|
| 5,768,281 | A * | 6/1998 | Takano | 370/503 |
| 5,835,793 | A * | 11/1998 | Li et al. | 712/300 |
| 6,014,766 | A * | 1/2000 | Nagai et al. | 714/764 |
| 6,052,415 | A * | 4/2000 | Carr et al. | 375/240.12 |
| 6,108,584 | A * | 8/2000 | Edwards | 700/94 |
| 6,141,385 | A * | 10/2000 | Yamaji | 375/240.27 |
| 6,597,961 | B1 * | 7/2003 | Cooke | 700/94 |
| 6,963,612 | B2 * | 11/2005 | Haddad | 375/240.25 |
| 2003/0014241 | A1 * | 1/2003 | Ferris et al. | 704/200.1 |

FOREIGN PATENT DOCUMENTS

| | | |
|---|---|---|
| EP | 739100 | 10/1996 |

OTHER PUBLICATIONS

D. Pan: "A Tutorial on MPEG/Audio Compression", IEEE Multimedia, IEEE Computer Society US, vol. 2, No. 2, 1995, pp. 60-74.

"Storage of a Data Signal in PASC Frames" Research Disclosure, Kenneth Mason Publns, Hampshire, GB, No. 385, May 1, 1996, p. 308.

Search report dated Dec. 6, 2002.

E.F. Schroeder et al: "Der MPEG-2-Standard: Generische Codierung Fuer Bewigtbilder und Zugehoerige Audio-Information. Audio-Codierung (Teil 4)", Fernseh und Kinotechnik, vol. 48, No. 7/8, Aug. 30, 1994, pp. 364-368, 370-373.

* cited by examiner

DETERMINATION OF THE PRESENCE OF ADDITIONAL CODED DATA IN A DATA FRAME

This application claims the benefit, under 35 U.S.C. § 365 of International Application PCT/EP02/12251, filed Nov. 2, 2002, which was published in accordance with PCT Article 21(2) on May 22, 2003 in English and which claims the benefit of European patent application No. 01250406.4, filed Nov. 17, 2001.

The invention relates to a method and to an apparatus for determining whether a data frame that is part of a bitstream besides coded standard data, e.g. mp3 data, contains coded additional data, e.g. mp3PRO data.

BACKGROUND

For audio coding, transmission and decoding, in particular for Internet applications, e.g. the audio coding standards ISO/IEC 11172-3, Layer III, ISO/IEC 13818-3, Layer III (MPEG audio layer III) and ISO/IEC 13818-7 are used for data re-duction. A widely used abbreviation for such type of coding/transmission/decoding is 'mp3'.

A common feature of these and other well-known audio coding standards is that the encoded data are formatted into a sequence of fixed-length data frames to be transferred as data streams or to be stored as data files. Every frame contains data for a certain temporal length (e.g. 24 ms) of a section of the original audio signal. The data frames include headers, data fields with particularly important information (side information), data fields with strongly variable information (main information) and, in many cases, a remaining data field without generally defined information. The latter data field is not specifically defined in the ISO/IEC standards, is denoted as 'ancillary data' and can be utilised freely for various purposes.

A reason for having in the data frames data fields without particular information is that the amount of information initially coded for a data frame varies strongly depending on the current characteristic of the original audio signal and—although the coder control basically aims at outputting a constant data rate per data frame—never contains an amount amount of finally encoded data corresponding exactly to the fixed length of the data frame. In other words, one of the tasks of an encoder is controlling the encoding such that the encoded data just fits into the frames at a given total data rate (and thereby absolute length of a data frame in bits). This goal is usually tried to be achieved by adapting the encoding quality, e.g. the level of the coarseness of the quantisation. However, by these means the encoder cannot only be ordered to persistently try to fill but not to overload the data frames, but can also be ordered to persistently keep at least a certain amount of data per data frame for 'ancillary data'.

FIG. 1 shows the typical configuration of an mp3 data stream with a plurality of frames n . . . n+3. Each frame starts with a header and a side information field. Side information is e.g. sampling frequency, scale factors, quantisation information and stereo/mono information. The main information fields 1 to 4 contain the coded audio signal coefficients. The side information fields can also contain pointers 'main_data_begin' stating the address of the corresponding first bit of the main information field. Also depicted are the positions for the 'ancillary data' fields that, if present, follow the main information field.

Figure 3:
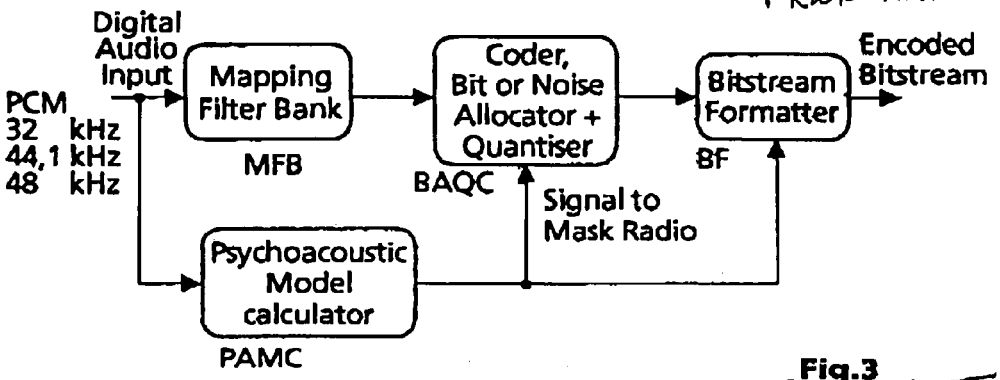
Fig.3 PRIOR ART

FIG. 3 illustrates the basic structure of an audio encoder that provides a bitstream according to FIG. 1. Input audio samples are fed into the encoder. The mapping and filter bank stage MFB creates a filtered and subsampled short-term frequency domain representation of the original input signal, i.e. transformed subband samples or coefficients. A psychoacoustic model stage PAMC is used for calculating a set of data (e.g. the signal to mask ratio) to control the bit allocator/quantiser and coder stage BAQC. The bitstream formatter BF assembles the actual bitstream from the output data of the other blocks, adds other information (e.g. error correction) and forms constant-length data frames.

THOMSON multimedia and Coding Technologies have recently introduced the 'mp3PRO' format that is an extension of the mp3 format. The additional mp3PRO data required are transferred as 'ancillary data' in the corresponding data frame fields. The encoded mp3PRO bitstreams are compatible with encoded mp3 bitstreams so that older mp3 players or decoders can easily decode and reproduce the mp3PRO bitstreams or files by not making use of the 'ancillary data'.

INVENTION

Because the specific mp3PRO data are transferred as 'ancillary data' the bitstreams are at first glance not detected as being mp3PRO bitstreams instead of mp3 bitstreams. However, in various applications—e.g. Internet music search machines—a necessity arises for a fast determination of the types of the bitstreams.

Such determination is normally executed using an mp3PRO decoder. Because the additional information is stored in the ancillary data field and because the frame header does not contain a corresponding pointer to the start address of the ancillary data field, an mp3PRO decoder must first completely decode at least one data frame according to the mp3 standard in order to find the end address of the mp3 data and thereby the following start address of the mp3PRO data in that data frame.

Thereafter the mp3PRO decoder must examine the data following in the data stream for characteristics that are typical for mp3PRO additional (supplementary) information. The latter step and in particular the above-mentioned mp3 decoding require a significant computational burden. A further aspect is that the initial mp3-specific decoding steps could be unwelcome, e.g. for licensing reasons.

This has the disadvantage that a relatively large data area needs to be checked, and within that area the mp3PRO specific patterns can be produced accidentally by mp3 audio data. This would lead to a number of wrong detections, which in turn would increase the necessary computational power. According to the invention, these disadvantages can be reduced by limiting the search area with the aid of easily obtainable other information. An unknown mp3 or mp3PRO bitstream is directly and automatically searched (no user interaction is required) for characteristics of the mp3PRO extension, e.g. for a specific type of header or for specific sync words, without performing a partial mp3 decoding and without making use of an mp3PRO decoder, in order to determine whether a current bitstream is of mp3 or of mp3PRO type.

The presence of certain data patterns can be checked by searching bit-wise the complete data of a data frame. Because the mp3PRO additional data is byte-aligned, the search can also be limited on complete byte boundaries and on byte-incremental steps.

Advantageously, the search for specific data patterns in the mp3PRO additional (supplementary) signal can be carried out by automatically checking—alternatively or in addition—whether a further candidate data pattern, which is neither a header nor a sync word, matches the mp3PRO-specific CRC (cyclic redundancy check) code.

The problem to be solved by the invention is determining whether a current bitstream is of mp3 or of mp3PRO type, thereby neither using mp3-typical decoding steps nor an mp3PRO decoder. This problem is solved by the method disclosed in claim 1. An apparatus that utilises this method is disclosed in claim 8.

In principle, the inventive method is suited for determining whether a data frame that is part of a bitstream besides coded standard data, e.g. mp3 data, contains coded additional data, e.g. mp3PRO data, wherein said standard data include header data, side information data and main information data in corresponding data fields of said data frame, and can include an ancillary data field, and wherein said additional data, if present, are arranged in a data field within said ancillary data field and include specific error protection data together with specific main information data that are protected by said specific error protection data, and/or include specific identification data, e.g. specific header or specific sync data, and wherein no address value is provided in said bitstream for directly determining the begin or the end of said additional data field, but the begin or end of said additional is data field would be determined after decoding said standard data, and wherein said side information data can include address information pointing to one border of a main information data field, and wherein said ancillary data field is adjacent to said main information data field border but said additional data field is not necessarily fully occupying said ancillary data field and said additional data field is not adjacent to said main information data field border in case said additional data field is not fully occupying said ancillary data field, the method including the steps:

a) obtaining the data of at least a current data frame;

b) searching said current data frame for:

b1) one or more identification data that match said specific identification data, or b2) data that, when performing on it a predetermined error protection scheme, match said specific error protection data, or b3) the items under b1) and, if successful, the items under b2);

c) if a match under b1) or under b2) or a double-match under b3) has been found for said data frame, determining that said bitstream contains said coded additional data, or if a match under b1) or under b2) or a double-match under b3) has not been found for said data frame, determining that said bitstream does not contain said coded additional data.

In principle the inventive apparatus is suited for determining whether a data frame that is part of a bitstream besides coded standard data, e.g. mp3 data, contains coded additional data, e.g. mp3PRO data, wherein said standard data include header data, side information data and main information data in corresponding data fields of said data frame, and can include an ancillary data field, and wherein said additional data, if present, are arranged in a data field within said ancillary data field and include specific error protection data together with specific main information data that are protected by said specific error protection data, and/or include specific identification data, e.g. specific header or specific sync data, and wherein no address value is provided in said bitstream for directly determining the begin or the end of said additional data field, but the begin or end of said additional data field would be determined after decoding said standard data, and wherein said side information data can include address information pointing to one border of a main information data field, and wherein said ancillary data field is adjacent to said main information data field border but said additional data field is not necessarily fully occupying said ancillary data field and said additional data field is not adjacent to said main information data field border in case said additional data field is not fully occupying said ancillary data field, said apparatus including:

a) means for obtaining the data of at least a current data frame;

b) means for searching said current data frame for:

b1) one or more identification data that match said specific identification data, or b2) data that, when performing on it a predetermined error protection scheme, match said specific error protection data, or b3) the items under b1) and, if successful, the items under b2);

c) means for evaluating the comparison results, which, if a match under b1) or under b2) or a double-match under b3) has been found for said data frame, determine that said bitstream contains said coded additional data, or which, if a match under b1) or under b2) or a double-match under b3) has not been found for said data frame, determine that said bitstream does not contain said coded additional data.

Advantageous additional embodiments of the invention are disclosed in the respective dependent claims.

DRAWINGS

Figure 2:
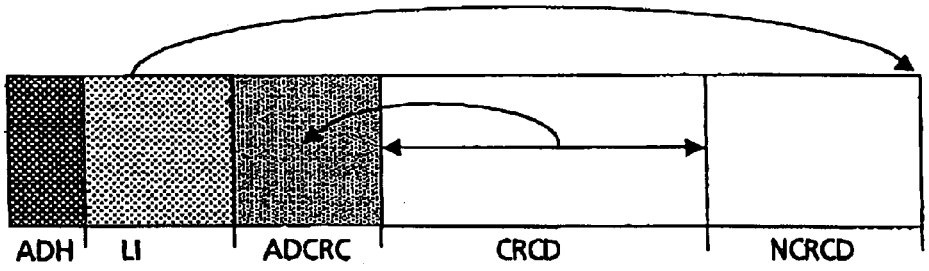
Fig.2 PRIOR ART
Figure 6:
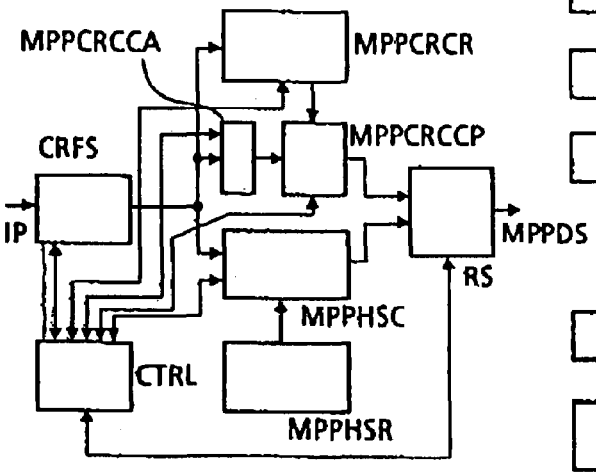
Figure 4:
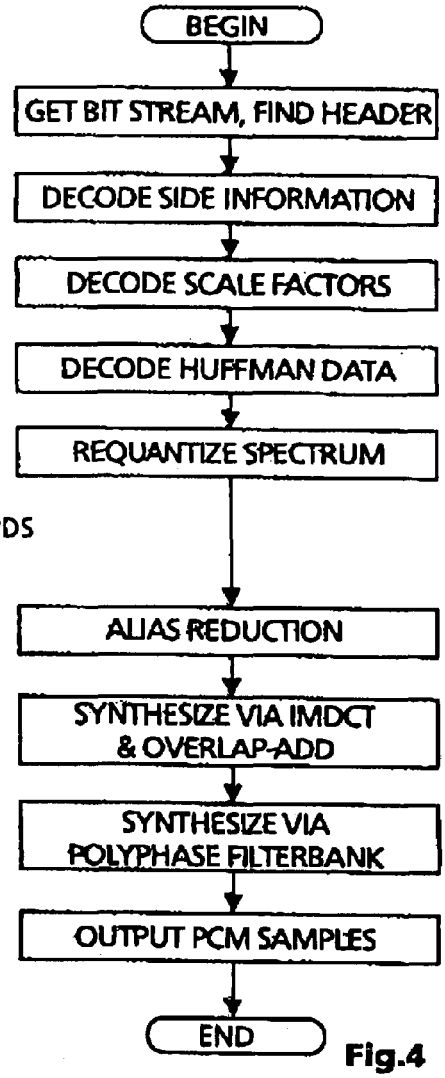
Figure 5:
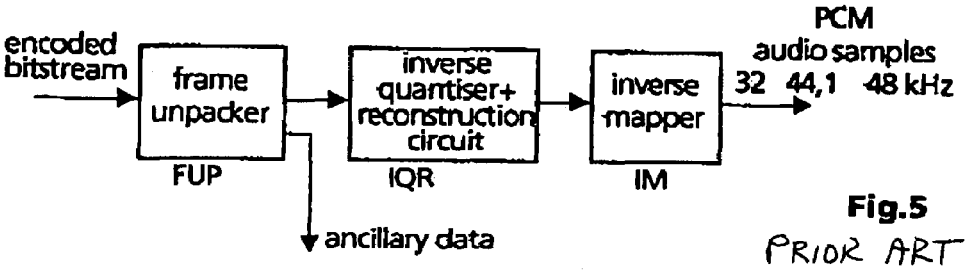
Fig.5 PRIOR ART

Exemplary embodiments of the invention are described with reference to the accompanying drawings, which show in:

FIG. 1 several data frames of an mp3 bitstream;

FIG. 2 basic data structure of the additional mp3PRO data transferred in the ancillary data fields of FIG. 1;

FIG. 3 basic block diagram of a known mp3 audio encoder;

FIG. 4 basic flowchart for the known mp3 encoding and decoding process;

FIG. 5 basic block diagram of a known mp3-audio decoder;

FIG. 6 block diagram for an inventive mp3/mp3PRO detector.

Figure 7:
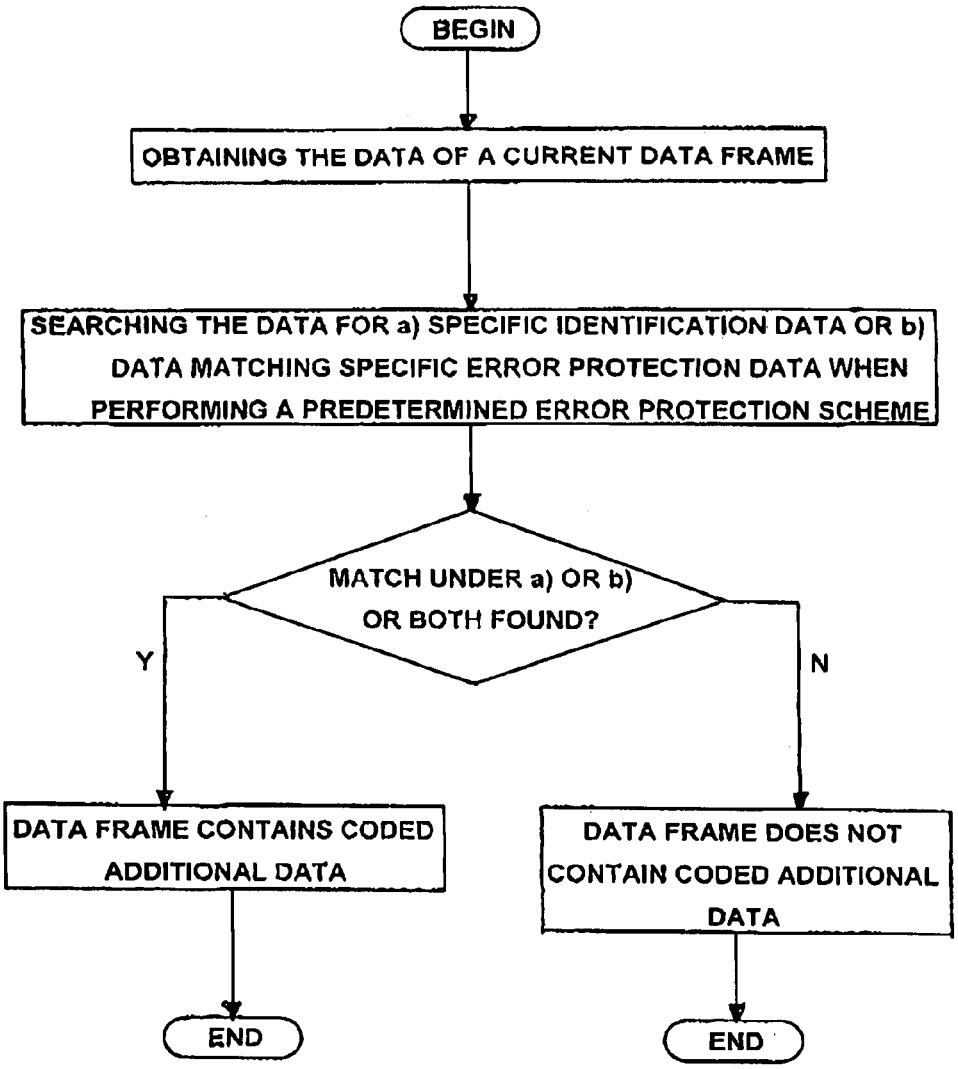

FIG. 7 basic flowchart for an inventive procedure for determining the presence of mp3PRO data in accordance with an embodiment of the invention.

EXEMPLARY EMBODIMENTS

FIG. 2 shows the fundamental structure of the additional information for an mp3PRO bitstream, this additional information being located within the 'ancillary data' fields of the mp3 bitstream depicted in FIG. 1. A specific mp3PRO header or a single or multiple non-identical identification patterns ADH are followed by a length information data field LI, a specific mp3PRO CRC check word ADCRC, a data field CRCD with CRC protected data, and a data field NCRCD with non-CRC protected data. The CRCD data are protected by the ADCRC word. LI contains length information or an address pointer to the end of the NCRCD data field. The CRCD and/or the NCRCD data are used for supplementing the coding/decoding of the mp3 encoded/decoded audio signal and thereby enhancing the overall quality of the audio signal. The CRCD data contains important information and the NCRCD data contains less important information for recovering the mp3PRO-specific information.

This kind of layered encoding and decoding has the advantage that existing mp3 decoders can easily receive and process mp3PRO bitstreams and data frames without being disturbed by the mp3PRO-specific data. Therefore an mp3 decoder does not detect a difference between an mp3 and an mp3PRO data stream. By these means mp3PRO is backwards compatible with mp3.

For the reliable determination of an mp3PRO bitstream it is basically sufficient that an mp3PRO decoder evaluates only a few data frames, because a main feature of an mp3PRO decoder is that it is constructed for that very determination process.

In ISO/IEC 11172-3 and 13818-3 data streams it is generally unknown where exactly the 'ancillary data' field begins. As mentioned above, the start address of this data field can be found by mp3 decoding the frame data.

Furthermore, in Layer 3/mp3 coding the end address of 'ancillary data' fields is not to be directly indicated but varies in a signal-dependent manner. The corresponding end address, which coincides with the beginning of the variable data of the following data frame is, however, indicated by a pointer denoted main_data_begin and is arranged in the header of that following data frame. Because this pointer can be found by partly evaluating the main information field of that data frame, it normally is not only necessary to decode the current data frame but also to evaluate the header of the following data frame in order to determine the presence of mp3PRO data.

In order to understand which mp3 decoding steps are not necessary for determining the presence of mp3PRO data according to the invention, FIG. 4 shows the normally required stateof-the-art mp3 decoding steps and FIG. 5 illustrates the basic structure of a corresponding mp3-audio decoder. Bitstream data is fed into the decoder of FIG. 5. The bitstream data are unpacked in a frame unpacker and decoding block FUP that performs error detection and recovers various pieces of information including the necessary side information. The inverse quantisation and reconstruction circuit IQR reconstructs the quantised version of the set of mapped samples. The inverse mapper IM transforms the mapped samples back into uniform PCM samples. The mp3PRO format requires additional decoding stages.

In FIG. 4 the steps from "Decode scale factors" to "Output PCM samples", as well as specific mp3PRO decoding steps (not depicted) can be omitted according to the invention.

The inventive procedure for determining the presence of mp3PRO data is as follows:

Obtaining the data of at least one current mp3 or mp3PRO data frame;

Obtaining from the following frame header data, at least until the pointer main_data_begin is retrieved;

Searching, until arriving at the main_data_begin address, bit-wise the current data frame for one or more candidate mp3PRO identification patterns (header or sync), whereby such pattern can appear accidentally in the mp3 data stream;

After finding a candidate mp3PRO identification pattern, performing CRC check of the data following the candidate mp3PRO identification pattern and the length information field LI;

Comparing the CRC check result with the CRC-word ADCRC;

If both are matching (and no transmission error has occurred) the candidate mp3PRO identification pattern is dealt to be a correct mp3PRO identification pattern and the data stream is considered to be an mp3PRO data stream;

If both are non-matching, continuing searching as above described during a certain time period for the next occurring candidate mp3PRO identification pattern;

If no such candidate mp3PRO identification pattern is found within that time period, determining that no mp3PRO data stream is present.

FIG. 6 depicts a corresponding mp3PRO data detector. The bitstream input data IP are fed to a clock recovery and data frame slicer stage CRFS. This stage may also carry out an error correction and provides the required data frame data to a data identifier comparator MPPHSC that compares corresponding identifier data stored in an identifier memory MPPHSR with the received data parts of the data frame. MPPHSR may in particular store mp3PRO header or sync data. MPPHSC may in particular compare stored mp3PRO header or sync data with received header or sync data. Stage CRFS provides the required data frame data also to a CRC calculator MPPCRCCA that calculates a corresponding CRC checkword for the supplied data. The calculated CRC checkword is compared in MPPCRCCP with a checkword stored in a CRC data memory MPPCRCR. MPPCRCR may in particular store mp3PRO CRC data (from the ADCRC field). A result stage RS receives the output signals of MPPHSC and MPPCRCCP and provides the final detection signal MPPDS, in particular an mp3PRO data detection signal. CRFS, MPPHSC, MPPCRCCA, MPPCRCCR, MPPCRCCP and RS are controlled by a controller CTRL, which controls e.g. the search step size and the search direction.

The above procedure can be modified as follows:

a) Searching in byte steps only, because the mp3PRO data is byte-aligned.

b) Starting the search not directly at the beginning of the data frames because the MPEG-header has a known length, and because even in case of 'zero' audio information the field of ancillary data does not start directly at the beginning of the data frame. A small degree of initial parsing of frame data can be helpful, which steps require clearly less effort than a complete decoding of the entire audio data of a data frame. Such steps can be:

determining the position of the main_data_begin pointer, which in mp3 immediately follows the fixed-length header data;

determining the length of the 'side info' data field, which in mp3 depends on:

single channel or dual channel format;

MPEG-1 (ISO/IEC 11172-3) or MPEG-2 (ISO/IEC 13818-3).

Both information items can be found in the header data.

c) Stopping the search in case a data field is reached that is identified by the pointer from the following header as the 'main_data_begin' for the following data frame.

d) Performing the search in the opposite direction, starting from the address 'main_data_begin' bits before the beginning of the header to follow.

e) Performing the search in the opposite direction, starting from the address 'main_data_begin+nmin' bits before the beginning of the header to follow. Thereby the minimum length (nmin bits) of the additional mp3PRO specific data is taken into account in order to further shorten the data field to be searched.

f) Like d) or e) but in a byte-aligned manner.

g) For improving the determination reliability, repeating the search in a further data frame, e.g. in the immediately following data frame, or in further data frames.

Advantageously in the invention no complete mp3 decoding and no partial or complete mp3PRO decoding is necessary for determining whether the data stream is an mp3PRO data stream. The required processing capabilities are minimum. The search and the bitstream type determination can be carried out automatically and in a faster way.

The invention can be used for all similar data structures, including video data structures, in which within fixed data frames at an unknown position additional data can be transferred and their presence is to be determined.

The invention claimed is:

1. Method for determining whether a data frame that is part of a bitstream (IP), besides coded ISO/IEC 11172-3 Layer III, ISO/IEC 13818-3 Layer III or ISO/IEC 13818-7 standard data denoted mp3 data, contains mp3PRO-coded additional data denoted mp3PRO data, wherein said standard data include header data, side information data and main information data in corresponding data fields of said data frame, and can include an ancillary data field, and wherein said additional data, if present, are arranged in a data field within said ancillary data field and include specific error protection data (ADCRC) together with specific main information data (CRCD) that are protected by said specific error protection data, and/or include specific identification data (ADH), such as specific header or specific sync data, and wherein no address value is provided in said bitstream for directly determining the begin or the end of said additional data field, but the begin of said additional data field would be determined after decoding said standard data, and wherein said side information data can include address information (main_data_begin) pointing to the beginning of the main information data field contained in the data frame preceding said current data frame, and wherein said ancillary data field is adjacent to said main information data field border but said additional data field is not necessarily fully occupying said ancillary data field and said additional data field is not adjacent to said main information data field border in case said additional data field is not fully occupying said ancillary data field, characterised by the steps:

a) obtaining (CRFS) for audio decoding the encoded data of at least a transmitted current data frame;

b) searching (MMPHSC, MMPCRCCA, MMPCRCCP), without decoding said main information data, said current data frame for:

b1) identification data that match said specific identification data (ADH), or b2) data that, when performing on it a predetermined error protection scheme, match said specific error protection data (ADCRC), or b3) the items under b1) and, if successful, the items under b2), wherein said searching in said current data frame does not stop at its end but when reaching the pointed beginning of the main information data field;

c) if a match under b1) or under b2) or a double-match under b3) has been found for said data frame, determining (RS, MPPDS) that said bitstream (IP) contains said coded additional data, or if a match under b1) or under b2) or a double-match under b3) has not been found for said data frame, determining (RS, MPPDS) that said bitstream (IP) does not contain said coded additional data.

2. Method according to claim 1, wherein said searching (MMPHSC, MMPCRCCA, MMPCRCCP) in said current data frame does not start at its beginning but following said header data.

3. Method for determining whether a data frame that is part of a bitstream (IP). besides coded ISO/IEC 11172-3 Layer III, ISO/IEC 13818-3 Layer III or ISO/IEC 13818-7 standard data denoted mp3 data, contains mp3PRO-coded additional data denoted mp3PRO data, wherein said standard data include header data, side information data and main information data in corresponding data fields of said data frame, and can include an ancillary data field, and wherein said additional data, if present, are arranged in a data field within said ancillary data field and include specific error protection data (ADCRC) together with specific main information data (CRCD) that are protected by said specific error protection data, and/or include specific identification data (ADH), such as specific header or specific sync data, and wherein no address value is provided In said bitstream for directly determining the begin or the end of said additional data field, but the begin of said additional data field would be determined after decoding said standard data, and wherein said side information data can include address information (main_data_begin) pointing to the beginning of the main information data field contained in the data frame preceding said current data frame, and wherein said ancillary data field is adjacent to said main information data field border but said additional data field is not necessarily fully occupying said ancillary data field and said additional data field is not adjacent to said main information data field border in case said additional data field is not fully occupying said ancillary data field, characterised by the steps:

a) obtaining (CRFS) for audio decoding the encoded data of at least a transmitted current data frame;

b) searching (MMPHSC. MMPCRCCA, MMPCRCCP), without decoding said main information data, said current data frame for;

b1) Identification data That match said specific identification data (ADH), or b2) data that, when performing on it a predetermined error protection scheme, match said specific error protection data (ADCRC), or b3) the Items under b1) arid, if successful, the items under b2).

wherein said searching in said current data frame starts from the pointed beginning of the main information data field towards the beginning of said current data frame, or from an address that is located a length equal to the additional data field minimum length prior to the pointed beginning of the main information data field, towards the beginning of said current data frame;

c) if a match under b1) or under b2) or a double-match under b3) has been found for said data frame, determining (RS, MPPDS) that said bitstream (IP) contains said coded additional data, or if a match under b1) or under b2) or a double-match under b3) has not been found for said data frame, determining (RS, MPPDS) that said bitstream (IP) does not contain said coded additional data.

4. Method for determining whether a data frame that is part of a bitstream (IP), besides coded ISO/IEC 11172-3 Layer III, ISO/IEC 13818-3 Layer III or ISO/IEC 13818-7 standard data denoted mp3 data, contains mp3PRO-coded additional data denoted mp3PRO data, wherein said standard data include header data, side information data and main information data in corresponding data fields of said data frame, and can include an ancillary data field, and wherein said additional data, if present, are arranged in a data field within said ancillary data field and include specific error protection data (ADCRC) together with specific main information data (CRCD) that are protected by said specific error protection data, and/or include specific identification data (ADH), such as specific header or specific sync data, and wherein no address value is provided in said bitstream for directly determining the begin or the end of said additional data field, but the begin of said additional data field would be determined after decoding said standard data, and wherein said side information data can include address information (main_data_begin) pointing to one border of a main information data field, and wherein said ancillary data field is adjacent to said main Information data field border but said addi-tional data field is not necessarily fully occupying said ancillary data field and said additional data field is not adjacent to said main information data field border in case said additional data field is not fully occupying said ancillary data field, characterised by the steps:

a) obtaining (CRFS) for audio decoding the encoded data of at least a transmitted current data frame;

b) searching (MMPHSC, MMPCRCCA, MMPCRCCP), without decoding said main information data, said current data frame for:

b1) identification data that match said specific identification data (ADH), or b2) data that when performing on it a predetermined error protection scheme, match said specific error protection data (ADCRC), or b3) the items under b1) and, if successful, the items under b2), wherein said searching is repeated during a given time period within one or more other data frames of said bitstream, and wherein the search results are combined in order to improve the determination reliability of the final result;

c) if a match under b1) or under b2) or a double-match under b3) has been found for said data frame, determining (RS, MPPDS) that said bitstream (IP) contains said coded additional data, or if a match under b1) or under b2) or a double-match under b3) has not been found for said data frame, determining (RS, MPPDS) that said bitstream (IP) does not contain said coded additional data.

5. Method according to one of claims 1 to 4, wherein said searching (MMPHSC, MMPCRCCA, MMPCRCCP) is carried out either bit-wise or byte-wise.

6. Apparatus for determining whether a data frame that is part of a bitstream (iP), besides coded ISO/IEC 11172-3 Layer III, ISO/IEC 13818-3 Layer III or ISO/IEC 13818-7 standard data denoted mp3 data, contains mp3PRO-coded additional data denoted mp3PRO data, wherein said standard data include header data, side information data and main information data in corresponding data fields of said data frame, and can include an ancillary data field, and wherein said additional data, if present are arranged in a data field within said ancillary data field and include specific error protection data (ADCRC) together with specific main information data (CRCD) That are protected by said specific error protection data, and/or include specific identification data (ADH), such as specific header or specific sync data, and wherein no address value is provided in said bitstream for directly determining the begin or the end of said additional data field, but the begin of said additional data field would be determined after decoding said standard data, and wherein said side information data can include address information (main_data_begin) pointing to the beginning of the main information data field contained in the data frame preceding said current data frame, and wherein said ancillary data field is adjacent to said main information data field border but said additional data field is not necessarily fully occupying said ancillary data field and said additional data field is not adjacent to said main information data field border in case said additional data field is not fully occupying said ancillary data field, said apparatus including:

a) means (CRFS) for obtaining for audio decoding the encoded data of at least a transmitted current data frame;

b) means (MMPHSC, MMPCRCCA, MMPCRCCP) for searching, without decoding said main information data, said current data frame for b1) identification data that match said specific identification data (ADH), or b2) data that, when performing on it a predetermined error protection scheme, match said specific error protection data (ADCRC), or b3) the items under b1) and, if successful, the items under b2), wherein the search in said current data frame does not stop at its end but when reaching the pointed beginning of the main information data field;

c) means (RS) for evaluating the comparison results, which, if a match under b1) or under b2) or a double-match under b3) has been found for said data frame, determine (MPPDS) that said bitstream (IP) contains said coded additional data, or which, if a match under b1) or under b2) or a double-match under b3) has not been found for said data frame, determine (MPPDS) that said bitstream (IP) does not contain said coded additional data.

7. Apparatus according to claim 6, wherein said searching (MMPHSC, MMPCRCCA, MMPCRCCP) in said current data frame does not start at its beginning but following said header data.

8. Apparatus for determining whether a data frame that is part of a bitstream (IP), besides coded ISO/IEC 11172-3 Layer III, ISO/IEC 13818-3 Layer III or ISO/IEC 13818-7 standard data denoted mp3 date, contains mp3PRO-coded additional data denoted mp3PRO data, wherein said standard data include header data, side information data and main information data in corresponding data fields of said data frame, and can include an ancillary data field, and wherein said additional data, if present, are arranged in a data field within said ancillary data field and include specific error protection data (ADCRC) together with specific main information data (CRCD) that are protected by said specific error protection data, and/or include specific identification data (ADH), such as specific header or specific sync data, and wherein no address value is provided in said bitstream for directly determining the begin or the end of said additional data field, but the begin of said additional data field would be determined after decoding said standard data, and wherein said side information data can include address information (main_data_begin) pointing to the beginning of the main information data field contained in the data frame preceding said current data frame, and wherein said ancillary data field is adjacent to said main information data field border but said additional data field is not necessarily fully occupying said ancillary data field and said additional data field is not adjacent to said main information data field border in case said additional data field is not fully occupying said ancillary data field, said apparatus including:

a) means (CRFS) for obtaining for audio decoding the encoded data of at least a transmitted current data frame;

b) means (MMPHSC, MMPCRCCA, MMPCRCCP) for searching, without decoding said main information data, said current data frame for;

b1) identification data that match said specific identification data (ADH), or b2) data that, when performing on it a predetermined error protection scheme, match said specific error protection data (ADCRC), or b3) the items under b1) and, if successful, the items under b2), wherein the search in said current data frame starts from the pointed beginning of the main information, data field towards the beginning of the current data frame, or from an address that is located a length equal to the additional data field minimum length prior to the pointed beginning of the main information data field, towards the beginning of said current data frame;

c) means (RS) for evaluating the comparison results, which, If a match under b1) or under b2) or a double-match under b3) has been found for said data frame, determine (MPPDS) that said bitstream (IP) contains said coded additional data, or which, if a match under b1) or under b2) or a double-match under b3) has not been found for said data frame, determine (MPPDS) that said bitstream (IP) does not contain said coded additional data.

9. Apparatus for determining whether a data frame that is part of a bitstream (IP), besides coded ISO/IEC 11172-3 Layer III, ISO/IEC 13818-3 Layer III or ISO/IEC 13818-7 standard data denoted mp3 data, contains mp3PRO-ceded additional data denoted mp3PRO data, wherein said standard data include header data, side information data and main information data in corresponding data fields of said data frame, and can include an ancillary data field, and wherein said additional data, if present, are arranged in a data field within said ancillary data field and include specific error protection data (ADCRC) together with specific main information data (CRCD) that are protected by said specific error protection data, and/or include specific identification data (ADH), such as specific header or specific sync data, and wherein no address value is provided in Said bitstream for directly determining the begin or the end of said additional data field, but the begin of said additional data field would be determined after decoding said standard data, and wherein said side information data can include address information (main_data_begin) pointing to one border of a main Information data field, and wherein said ancillary data field is adjacent to said main information data field border but said additional data field is not necessarily fully occupying said ancillary data field and said additional data field is not adjacent to said main information data field border in case said additional data field is not fully occupying said ancillary data field, said apparatus including:

a) means (CRFS) for obtaining for audio decoding the encoded data of at least a transmitted current data frame;

b) means (MMPHSC, MMPCRCCA, MMPCRCCP) for searching, without decoding said main information data, said current data frame for;

b1) identification data that match said specific identification data (ADH), or b2) data that, when performing on it a predetermined error protection scheme, match said specific error protection data (ADCRC), or b3) the items under b1) and, if successful, the items under b2), wherein said searching is repeated during a given time period within one or more other data frames of said bitstream and wherein the search results are combined in order to improve the determination reliability of the final result;

c) means (RS) for evaluating the comparison results, which, if a match under b1) or under b2) or a double-match under b3) has been found for said data frame, determine (MPPDS) that said bitstream (IP) contains said coded additional data, or which, if a match under b1) or under b2) or a double-match under b3) has not been found for said data frame, determine (MPPDS) that said bitstream (IP) does not con-tain said coded additional data.

10. Apparatus according to one of claims 6 to 9, wherein said searching (MMPHSC, MMPCRCCA, MMPCRCCP) is carried out either bit-wise or byte-wise.

11. A method for determining a coding format of a data stream comprising the steps of:

receiving respective frames of data, each frame including a coder identification pattern and a first error checking code;

examining respective data portions of at least one of said frames to detect data patterns matching said coder identification pattern;

for at least one detected data pattern, error checking additional data in said frame to provide a second error checking code;

comparing said second error checking code with said first error checking code;

if said first error code matches said second error code selecting a decoding format in accordance with said coder identification pattern.

* * * * *